US006318570B1

(12) United States Patent
Mueller et al.

(10) Patent No.: US 6,318,570 B1
(45) Date of Patent: Nov. 20, 2001

(54) STACKABLE AND NESTABLE RACKS

(75) Inventors: Lou Mueller; Paul M. Denk, both of St. Louis, MO (US)

(73) Assignee: John Gusdorf and Associates Ltd., St. Louis, MO (US)

( * ) Notice: Subject to any disclaimer, the term of this patent is extended or adjusted under 35 U.S.C. 154(b) by 0 days.

(21) Appl. No.: 09/065,678

(22) Filed: Apr. 23, 1998

Related U.S. Application Data

(60) Provisional application No. 60/044,261, filed on Apr. 24, 1997.

(51) Int. Cl.[7] ..... A47F 5/14

(52) U.S. Cl. ..... 211/181.1; 211/194; 211/149; 211/126.7; 211/188

(58) Field of Search ..... 211/188, 181.1, 211/194, 126.9, 126.8, 128.11, 149

(56) References Cited

U.S. PATENT DOCUMENTS

| | | | | |
|---|---|---|---|---|
| 576,393 | * | 2/1897 | Bos | 211/181.1 X |
| 967,600 | * | 8/1910 | Bernstein | 211/134 X |
| 1,946,711 | * | 2/1934 | Quisenberry | 211/181.1 X |
| 2,497,574 | * | 2/1950 | Bahnson | 211/126.9 X |
| 2,600,191 | | 5/1952 | Beach | 211/181.1 |
| 2,814,390 | | 11/1957 | Barbier | 211/175 |
| 2,926,022 | | 2/1960 | Nau et al. | 211/126.15 |
| 2,975,906 | | 3/1961 | Van Der Togt | 211/126.6 |
| 3,082,879 | * | 3/1963 | Wilson | 211/126.8 X |
| 3,160,308 | * | 12/1964 | Hare et al. | 211/126.8 X |
| 3,435,958 | | 4/1969 | Chesley | 211/186 X |
| 3,486,633 | * | 12/1969 | Wilson | 211/126.9 X |
| 3,524,565 | * | 8/1970 | Wilson | 211/126.8 X |
| 3,606,025 | * | 9/1971 | Wilson | 211/126.9 X |
| 3,848,748 | * | 11/1974 | Ceccarelli | 211/181.1 |
| 3,905,286 | * | 9/1975 | Le Grady | 211/181.1 X |
| 3,967,327 | * | 7/1976 | Severson | 211/149 X |
| 3,998,170 | * | 12/1976 | Gordon | 211/181.1 X |
| 4,079,836 | | 3/1978 | Von Stein et al. | 211/126.7 X |
| 4,444,320 | | 4/1984 | Chap | 211/194 X |
| 4,805,785 | | 2/1989 | Pfeifer et al. | 211/181.1 |
| 4,821,885 | | 4/1989 | Ondrasik | 211/505 |
| 4,862,602 | * | 9/1989 | Krill | 211/188 X |
| 4,915,238 | | 4/1990 | Cassel | 211/189 |
| 5,035,335 | | 7/1991 | Massoudnia | 211/181.1 |
| 5,074,223 | * | 12/1991 | Remmers | 211/188 X |
| 5,097,971 | * | 3/1992 | Norris et al. | 211/194 X |
| 5,152,407 | | 10/1992 | Massoudnia et al. | 211/126.15 |
| 5,213,221 | * | 5/1993 | Raye, Sr. | 211/181.1 X |

* cited by examiner

*Primary Examiner*—Daniel P. Stodola
*Assistant Examiner*—Khoa Tran
(74) *Attorney, Agent, or Firm*—Paul M Denk

(57) ABSTRACT

A stackable and nestable rack including a surface platform, formed of lateral and/or longitudinal wires, a perimeter frame at least formed along the sides of the formed platform, the rods forming the perimeter frame are bent downwardly, into the configuration of legs, and the legs are integrally bent or formed extending outwardly, and incorporate integral transverse rods formed of the feet to provide structure for stacking of two or more racks one upon the other, but with their integral rod formed of the feet assuring that a pair of stacked racks will remain erected, when stacked and assembled. In addition, a pair or more of the racks may be nested, together, into a very snug configuration, when stored. In a modification, the legs may include the protrusions, that bias against the rods forming the sides of the surface platform for a rack, so that the protrusions of the legs may encounter the surface platform, and more particularly its side rods, when a pair or more of the racks of this modified design are stacked one upon the other.

9 Claims, 6 Drawing Sheets

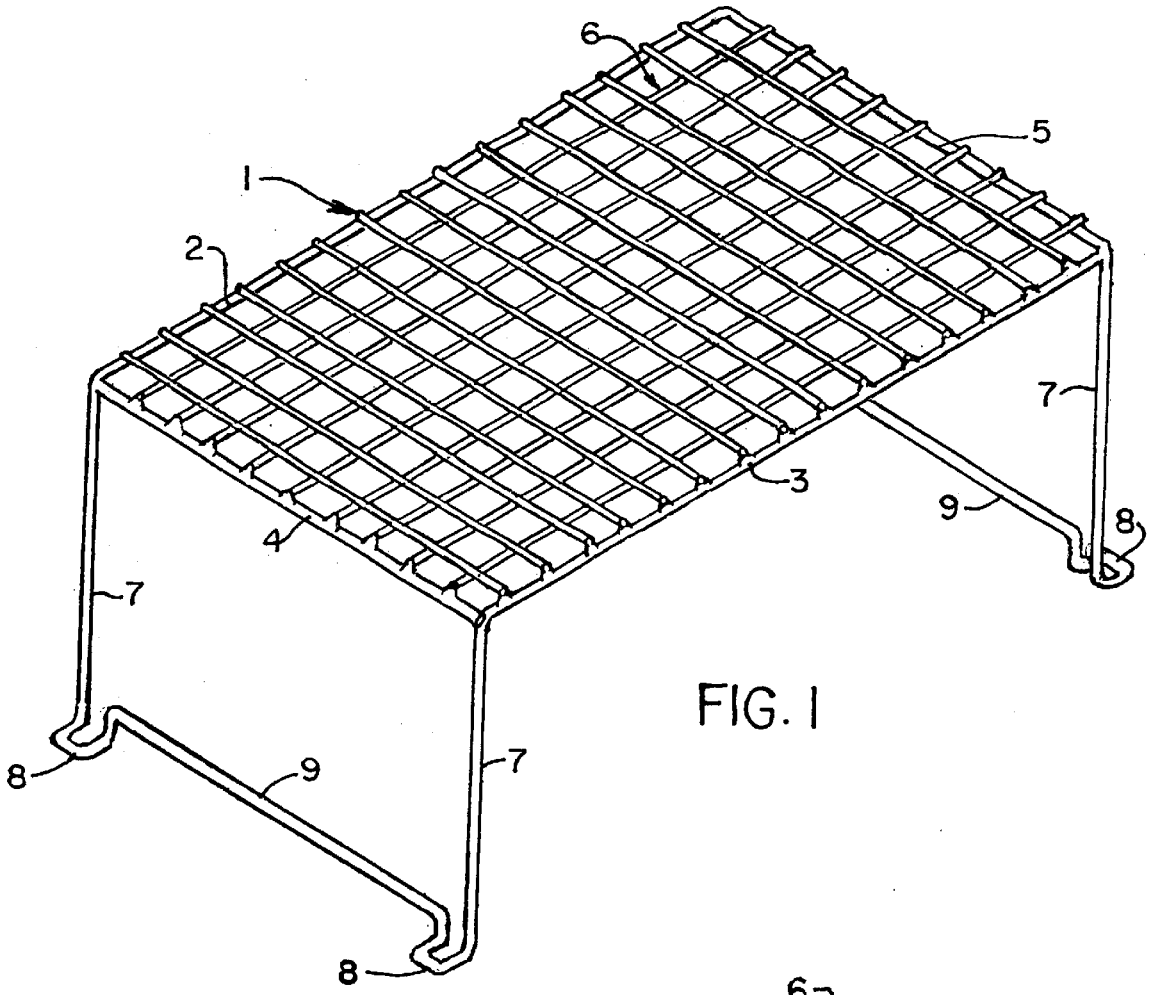
FIG. 1
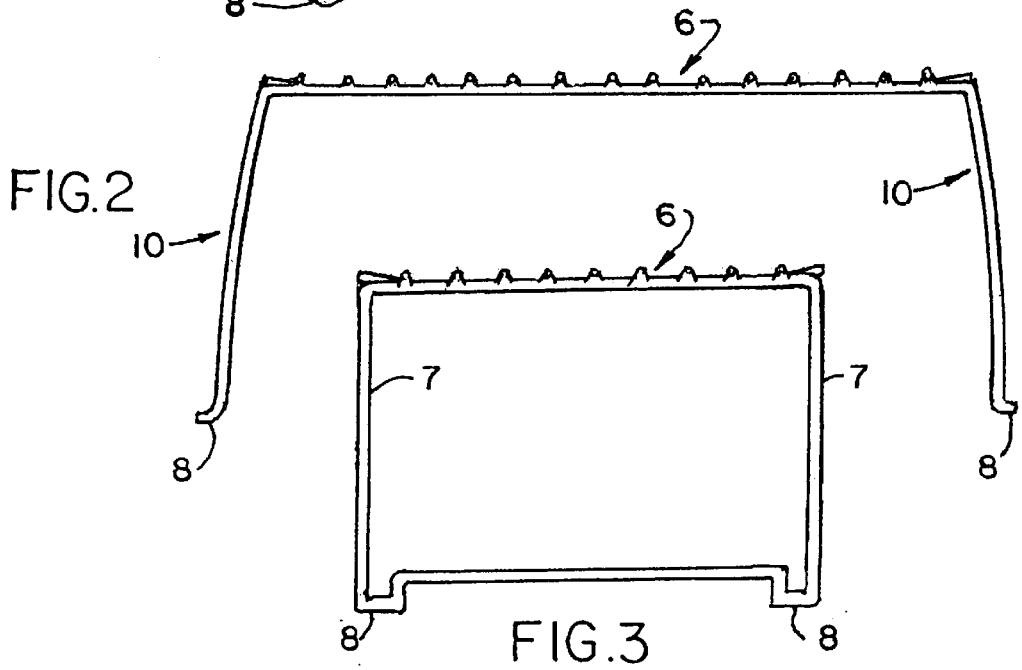
FIG.2
FIG.3

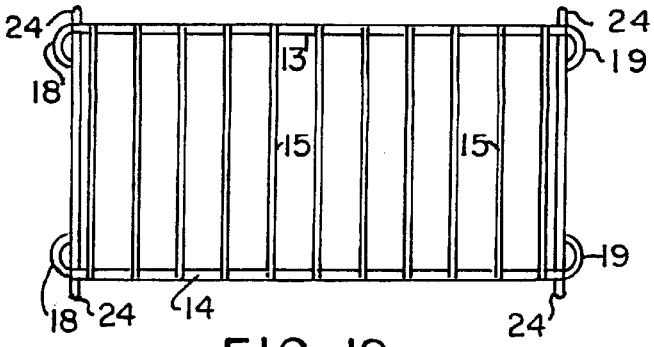
FIG. 12
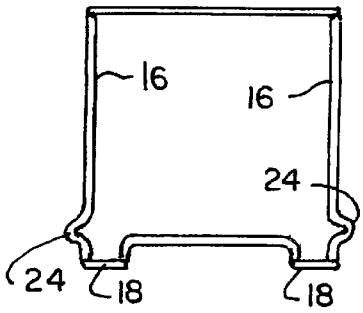
FIG. 13
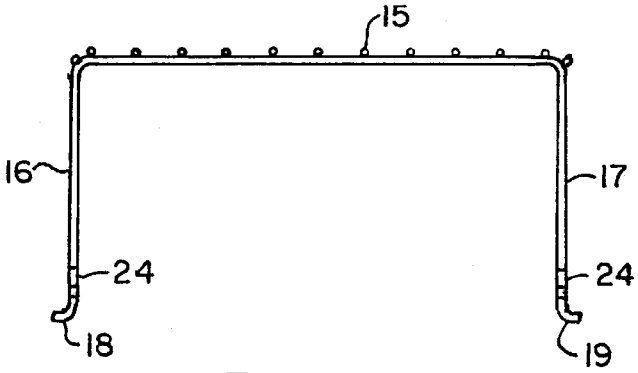
FIG. 14
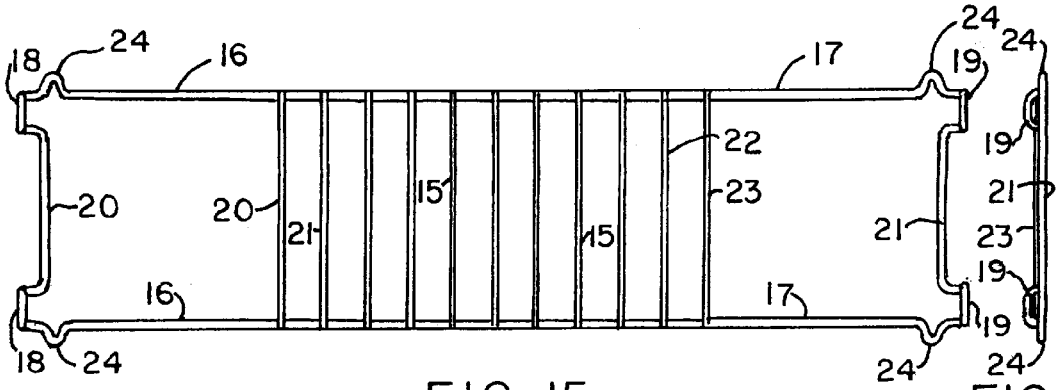
FIG. 15
FIG. 16
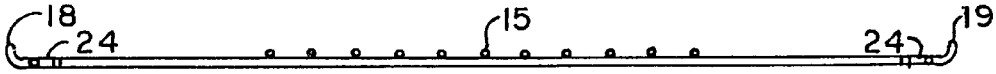
FIG. 17

STACKABLE AND NESTABLE RACKS

CROSS-REFERENCE TO RELATED APPLICATION

This application is a non-provisional patent application based upon provisional patent application having Ser. No. 60/044,261, filed on Apr. 24, 1997, and which is owned by a common assignee.

BACKGROUND OF THE INVENTION

Various styles of racks are available in the prior art, many of them relate to types of racks that have industrial application, such as for holding bottles, letters, or other components in a stacked relationship. Domestically, stackable and nestable racks have been available of a particular design, such as can be seen in the United States patents to Massoudnia, et al., U.S. Pat. Nos. 5,035,335 and 5,152,407. These patents are owned by an assignee affiliated with the applicants herein. As can be seen in these prior patents, the shown racks are both stackable, one on top the other, and can be erected into multiple heights, and in addition, as when not in use, the racks are nestable, one on top of the other, so as to reduce their size when undergoing shipment, placed in storage, or when displayed for sale. The essence of these previous racks is to provide an upstanding handle, proximate each end of the rack, that furnishes clearance between the upper part of the handle, and the platform or surface formed of the rack, so that the turned foot of the supra-adjacent rack may engage in some manner with the raised handle, to provide for their securement, and hold together, when two or more of the racks are lifted, but likewise, to provide for securement of the racks together, when stacked.

Various other prior art embodiments for miscellaneous types of racks are available in the art, to provide for stacking of one rack upon the other, such as can be seen in the previous United States patent to Barbier, U.S. Pat. No. 2,814,390; von Stein, et al, U.S. Pat. No. 4,079,836; Beach, U.S. Pat. No. 2,600,191; Pfeifer, et al., U.S. Pat. No. 4,805,785; Ondrasick, U.S. Pat. No. 4,821,885; Cassel, U.S. Pat. No. 4,915,238; Chesley, U.S. Pat. No. 3,435,958; and, vanDerTog, U.S. Pat. No.2,975,906. The shelves and racks as shown in these prior patents are far more complex of construction than that of this current invention, in many instances, were designed for industrial purposes, and just do not lend themselves well for use for simplified application for domestic storage and stacking of household goods, or for use for organizing closets. The United States patent to Chap, U.S. Pat. No. 4,444,320, discloses a stackable shelf unit, it is not identified as a nestable type shelf, but it discloses how the bottom of the legs of the shown unit are bent inwardly, and downwardly, so as to locate through the surface for the shown shelf. But, while this shelf unit may stack, it is not identified as one which may be nested, and furthermore, even when a plurality of such shelf units are stacked, one upon the other, they will not hold together, because the bent leg portions will simply separate from any subjacent unit, by sliding free of the same when lifted.

SUMMARY OF THE INVENTION

It is the principal object of this invention to provide a stackable and nestable rack, which affords a uniform platform entirely across the top of the formed rack, without any interference from any components forming the styled rack, but at the same time, providing interlocking means that hold one or more of the racks together, when stacked one upon the other, so that all of the racks may be lifted simultaneously, without separation.

It is another principal object of this invention to provide a rack of the foregoing design, and which is also nestable.

This invention contemplates the formation of a particularly styled rack, formed of a simplified design, but yet is quite unique in structure, appearance, affording a minimum of components to provide for its fabrication, but yet furnishes an attractive rack that may be both stackable, one upon the other, for assistance in organizing the storage of household or other goods, and at the same time, can be easily nested into a very contracted state, when a plurality of the racks are desired to be stored or shipped. Each of the racks is formed having an upper platform, of uniform planar dimension, and which upper platform provides a smooth transition from end to end, and likewise widthwise, without any further elevated components, so as to assure that goods may be easily stored thereon, as desired. Each of the racks is formed having down turned legs, at each end, and more specifically at each corner, of the formed platform, to provide elevation for the rack when stood upon a surface. The downward end of each rack incorporates an out turned foot portion, that has width slightly less than the dimensions between the grid work forming the upper surface platform, so that the foot portions may be inserted through a proximate corner grids, forming the surface platform, and underlie any transverse rod that form the end of the rack platform, to furnish interconnection of stacked racks together, even when a plurality of them are stacked, and are subject to a lifting force. Between each foot portion of a rack, there is provided a transverse integral rod, arranged slightly upwardly of the formed corner feet for the rack, and that rod comes to rest upon any longitudinal rods forming the surface platform for the rack, when a pair or more of the racks are stacked one upon the other, in the manner as previously described.

Another unique aspect of this invention is the method for formation of the described racks. The racks may generally be fabricated as a two-dimensional design, having the feet and transverse rod portions of the foot for the intended rack being either welded in place, or bent from integral wire structure, and then have at approximate its center portion the arrangement of the surface platform, formed by the upper end rods for the platform, the wire grid structure that forms the platform itself, and following this assembly, the legs may simply be bent down and formed into other angles, as may be necessary, to furnish the desired elevation to the finished rack, and also, to allow them to be stacked and nested, in the manner as previously explained.

Where the surface formed platform for the rack does not include any longitudinal wires, but only a series of transverse rods forming the surface, as can be understood, the racks, when stacked one upon the other, will not remain elevated, because the legs will simply slide through the surface platform of the subjacent rack and not remain suspended in its desired elevated position, when stacked one upon the other. Hence, it is intended that various types of protrusions may be provided proximate the lower end of the leg portions of each rack, and these protrusions may either be configured from an integral bending of the wires forming the legs, or have welded components fabricated thereto, which protrusions extend laterally and then engage the longitudinal wires forming the sides for the elevated surface platform, for the rack, and prevent the further descending of legs once they are inserted and installed as when a pair of racks are stacked one upon the other. Nevertheless, racks of this design and nature may yet be fabricated in a related lineal length, to facilitate the initial manufacture and set-up of the rack when being assembled, all of the various components may be spot welded in place, the feet and transverse rods forming the lower segment of the legs, in addition to the structural protrusions, may be preformed, and then the racks may be either shipped in that condition, for subsequent bending at their destination, just prior to their final coating, and shipment for marketing to the trade. This particular method and style for manufacture and assemble of racks of this design, particularly because they are fabricated of a simplified design with a minimum of components, and no moving or interengaging parts, are especially adaptive to their initial fabrication, for example, by a manufacturer overseas, shipped to a final assembly plant at a distant destination, and then finally bent, coated, painted, or otherwise treated for final appearance, and then shipped to a customer for display, marketing, and sale.

It is, therefore, the principal object of this invention to provide a stackable and nestable rack that may be fabricated generally as a two-dimensional or lineal product, and then subsequently bent into its usable configuration.

Still another object of this invention is to provide a rack which is both stackable and nestable, and fabricated from a minimum of components.

Yet another object of this invention is to provide a rack that is of simplified design, but yet very sturdy of structure, providing components that afford their interengagement together, when a pair or more of the racks are stacked, but yet can be easily disassembled, and nested together, into a minimum of space.

Still another object of this invention is to provide a rack that has a surface platform that is unencumbered with any elevated or protruding components upon its upper level storage surface area.

Still another object of this invention is to provide a rack, which is both stackable and nestable, and which is inexpensive of manufacture, and very simplified of usage, thereby allowing the homeowner to easily assemble and use the racks of this design for either domestic usage, of even for providing organization for closets, or the like.

Yet another object of this invention is to provide a stackable and nestable rack that can easily be used commercially, at a business, or even in industrial plants.

These and other objects will become more apparent to those skilled in the art upon reviewing the summary of the invention provided herein, and upon undertaking a study of the description of its preferred embodiment, in view of the drawings.

BRIEF DESCRIPTION OF THE DRAWINGS

In referring to the drawings,

FIG. 1 provides an isometric view of the stackable and nestable rack of this invention;

FIG. 2 is a side view thereof;

FIG. 3 is an end view thereof;

FIG. 11A is a partial view of the left end of the rack showing how the feet bend inwardly, instead of outwardly, as previously disclosed in FIG. 11;

FIG. 12 discloses a modified rack incorporating lateral protrusions to facilitate the stacking of one of such rack upon another;

FIG. 13 is an end view ofthe rack of FIG. 12;

FIG. 14 is a side view of the rack of FIG. 12;

FIG. 15 is a plan view of the rack of FIG. 12, in its lineal form, and before its legs are bent downwardly to provide elevation for the shown rack;

FIG. 16 is an end view of the rack of FIG. 15;

FIG. 17 is a side view of the rack of FIG. 15.

DESCRIPTION OF THE PREFERRED EMBODIMENT

Figure 4:
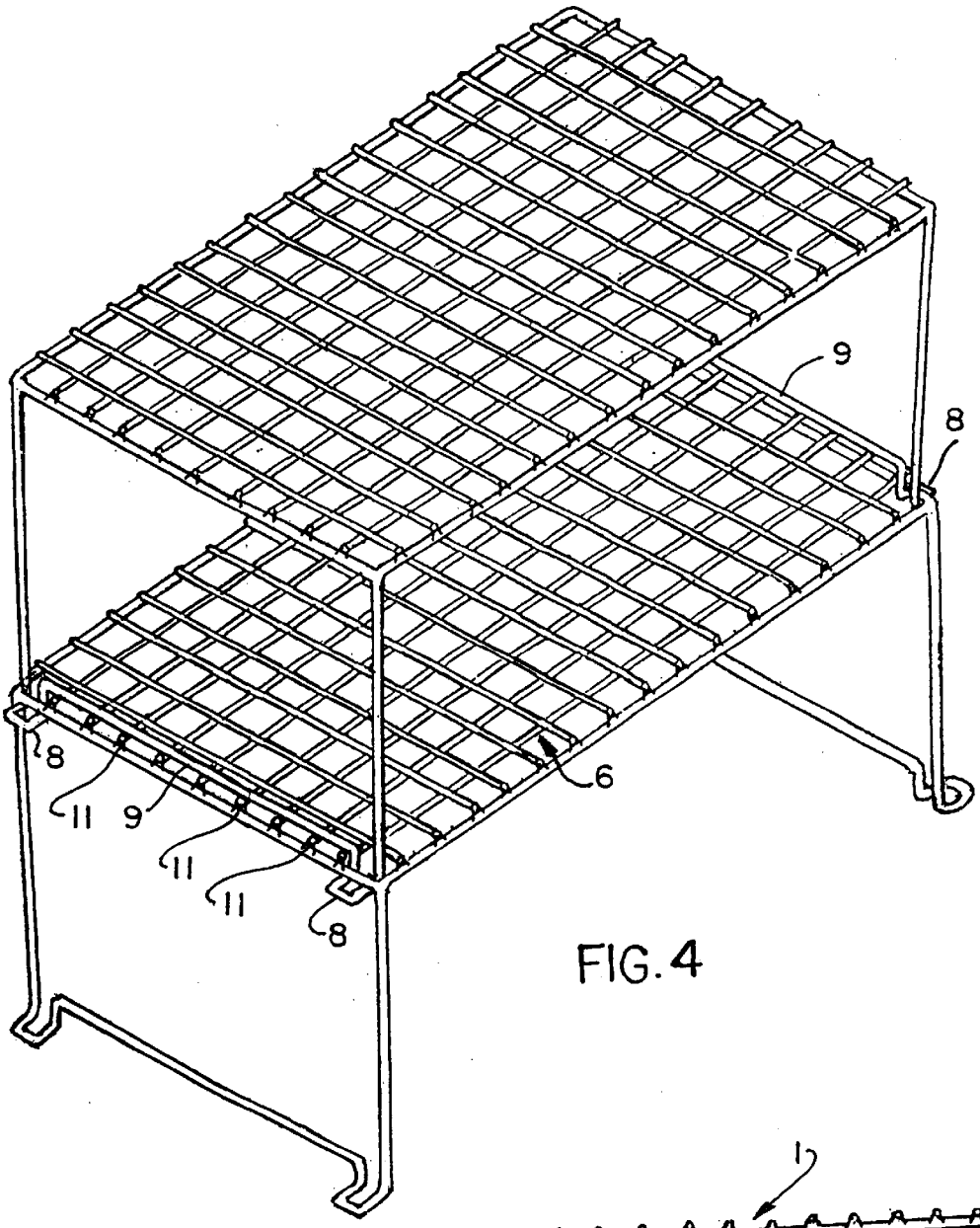
FIG. 4 discloses a pair of the racks stacked one upon the other.

In referring to the drawings, and in particular FIGS. 1 through 3, the stackable and nestable rack 1 of this invention is disclosed. The rack includes a perimeter frame, having at least laterally arranged wires or rods 2 and 3, and may also include end rods 4 and 5, although it is just as likely that the rods forming the surface platform 6, if they are sturdy enough, can form these particular components for the structured rack. At each end of the rack there are provided down-turned legs, as at 7, and at the bottom of each leg is formed an outwardly extending foot portion, or foot tab, as at 8. These are provided proximate each corner of the shown rack. Between the feet 8 is an integral or otherwise secured transverse rod or foot 9, which functions for the purposes as to be subsequently described.

Figure 5:
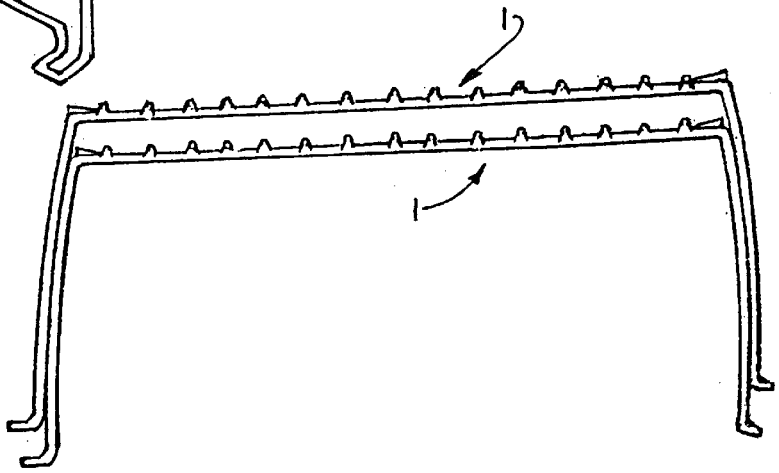
FIG. 5 discloses a pair of the racks nested one upon the other.

As can be seen in FIG. 2, the legs may be either vertically arranged, or angulated slightly outwardly, or bowed outwardly, as can be seen at 10, and thereby facilitate the nesting of a pair of racks together, when arranged one upon the other, as can be seen in FIG. 5. In addition, because of the slight outward disposition for the legs 7, as previously explained, when a pair or more of the racks are stacked one upon the other, as can be seen in FIG. 4, after the feet 8 at one end of the rack are inserted through the grid work forming surface platform 6 for the rack, the feet 8 at the opposite end of the rack, having their legs 7 biased or forced inwardly, against their inherent resiliency, may then be located downwardly through the surface platform for the subjacent rack, to provide for a very sturdy mount of a pair of racks together, when assembled.

As can be see in FIG. 4, the formed feet 8 of a rack have a width dimension slightly less than the dimensions of the grid work forming the surface platform 6, so that the feet may be easily slid therethrough, and then released, for providing for a biased interconnection of a pair or more of the racks together, once stacked one upon the other. As can further be seen, when a pair of the racks are stacked together, as disclosed in FIG. 4, the transverse rod 9 forming a pair of the foot assembly comes to rest upon the longitudinal disposed wires 11, so as to prevent any further downward dissent for the supra-adjacent rack, when stacked upon the rack arranged there below, as can be noted.

As previously explained, one or more of the racks 1 may be nested together, as disclosed in FIG. 5, as when they are not in use, or when they are shipped, stored, or displayed for sale.

Figure 6:
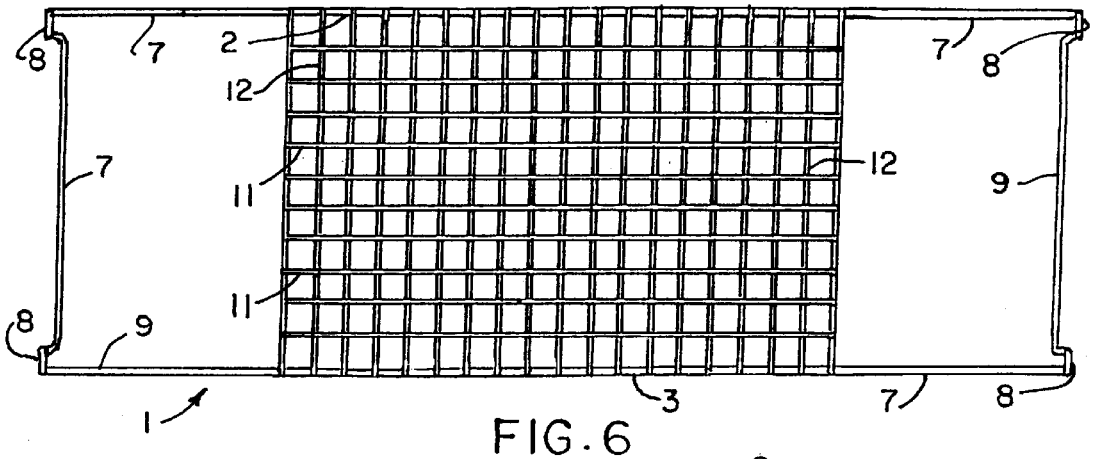
FIG. 6 discloses the rack in its lineal form, before the legs are bent downwardly.
Figure 7:
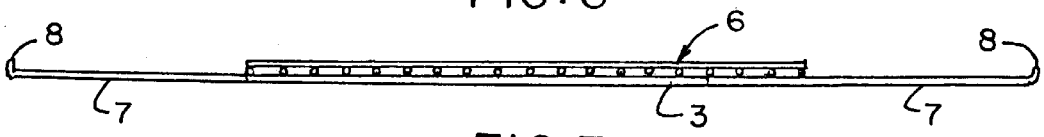
FIG. 7 is a side view of the linear rack of FIG. 6.
Figure 8:
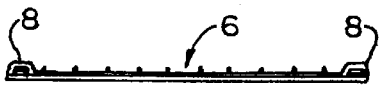
FIG. 8 is an end view of the linear rack of FIG. 6.
Figure 9:
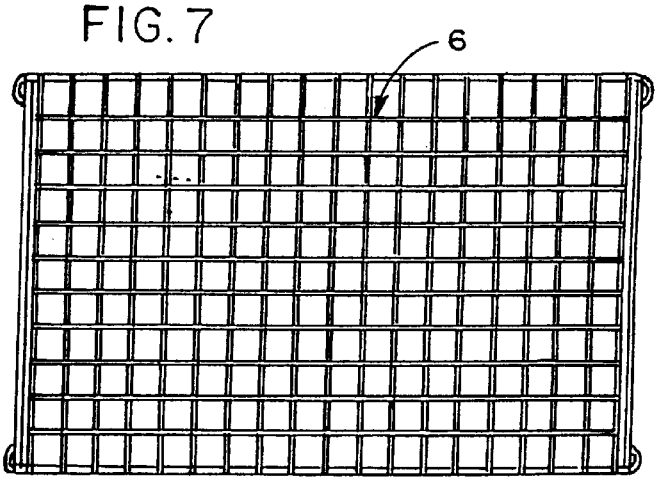
FIG. 9 is a plan view of the stackable and nestable rack of FIG. 1, but showing the surface platform as aligned within its perimeter frame.
Figure 10:
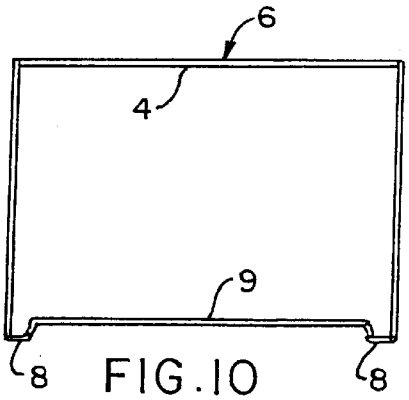
FIG. 10 is an end view of the rack of FIG. 9.
Figure 11:
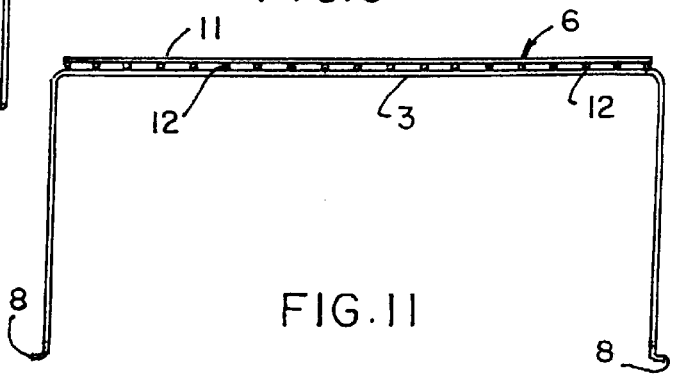
FIG. 11 is a side view thereof.

As can be seen in FIGS. 6 through 8, in the formation of the style of stackable and nestable rack 1 as previously explained, these racks may be fabricated, initially, into a linear configuration, as can be more clearly seen in FIG. 7, where the side wires 2 and 3 are arranged linearly along the sides of the forming rack, the feet and transverse rods 9 will have been bent or otherwise welded from the formed wire, to generally furnish a generally two-dimensional formed rack, before its legs are bent into the finished form. Furthermore, when in this position, the various longitudinal and lateral wires 11 and 12 forming the surface platform are arranged for their spot welding, into place, to provide incipient formation of a rack, but just before its legs are bent into a vertical position. But, when the racks are formed in this manner, and to the shape as shown in FIG. 7, they may easily be stacked one upon the other, and packaged for shipment to a distant destination, where they then can be bent into the usable configuration, in the manner as shown in FIG. 11. When finally bent, the legs may be either vertically arranged, as shown in FIG. 11, or slightly bowed, as described and shown in FIG. 2, depending upon the amount of resiliency desired for the legs, to provide for their interconnection with the surface platform of a subjacent rack, when stacked one upon the other. Also, as shown in FIGS. 9 and 10, the grid work of wires forming the surface platform 6 may be arranged generally within the perimeter frame 2 through 5, or it may rest upon the said perimeter frame, and welded in place, as shown in FIG. 11.

Once the rack is fully bent to its usable configuration, it may be spray painted, electrostatically or electrolytically painted, dipped for coating, or have any other type of surface preparation applied to it, or simply polished and used in that manner. When in that condition, and in that stage of assembly, the racks are ready for shipment and usage.

A variation to the structure of this invention is shown in FIGS. 12 through 17. As disclosed herein, the rack is formed of lateral frames formed of the wires 13 and 14, and are assembled through the welding or otherwise application of transverse rods 15 thereto. The wires formed into the lateral rods 13 and 14 are bent, at their ends, to form the legs 16 and 17, as can be seen. The bottom of the legs are formed having their pair of foot portions 18 and 19, which are shown as outwardly bent segments, and which are designed for functioning in the manner as previously described. In addition, the transverse rods 20 and 21 are formed of the foot portions, as can be noted, to add stability to the fabricated rack. But, since there are no longitudinally disposed wires or rods formed of the surface platform, as previously reviewed with respect to the structure of the rack of FIG. 1, once the foot portions 18 and 19 are inserted through the spacing between the end transverse rods 15, and more specifically, respectively, between the rods 20 and 21, and 22 and 23, obviously, since there are no longitudinal wires provided, the foot portions and legs of the rack stacked thereon would simply continue to fall therethrough, and prevent their stackability. Hence, when the surface platform is formed in the manner as shown, the legs 16 and 17 are formed with extending projections, as at 24, and which projections encounter the side rods 13 and 14, and prevent the racks from falling therethrough, when stacked one upon the other. Thus, this facilitates the stacking of one or more racks upon the other, and at the same time, since the foot portions 18 and 19 will slip under their associated transverse rods 20 and 23, the racks can be lifted together, without separation, as desired.

As can also be noted in FIGS. 15 through 17, this particular style of modified rack may also be fabricated in the manner of the rack as previously described in FIG. 6, where they may be formed initially in a more two-dimensional configuration, and more easily shipped, before their final assembly at a distant destination into the usable configuration, where their legs may be pressed and bent downwardly, into a configuration as previously described, essentially as shown in FIG. 14, and subsequently coated or finished for sale. Obviously, final coating or painting processes currently available are of such quality that it is also likely that the racks may be coated or otherwise finished when in the configurations as shown in FIGS. 6 and 15, and then subsequently have their legs bent into the usable and more vertically arranged or near vertical disposition, without having any detrimental effect upon their previously applied coating.

Figure 18:
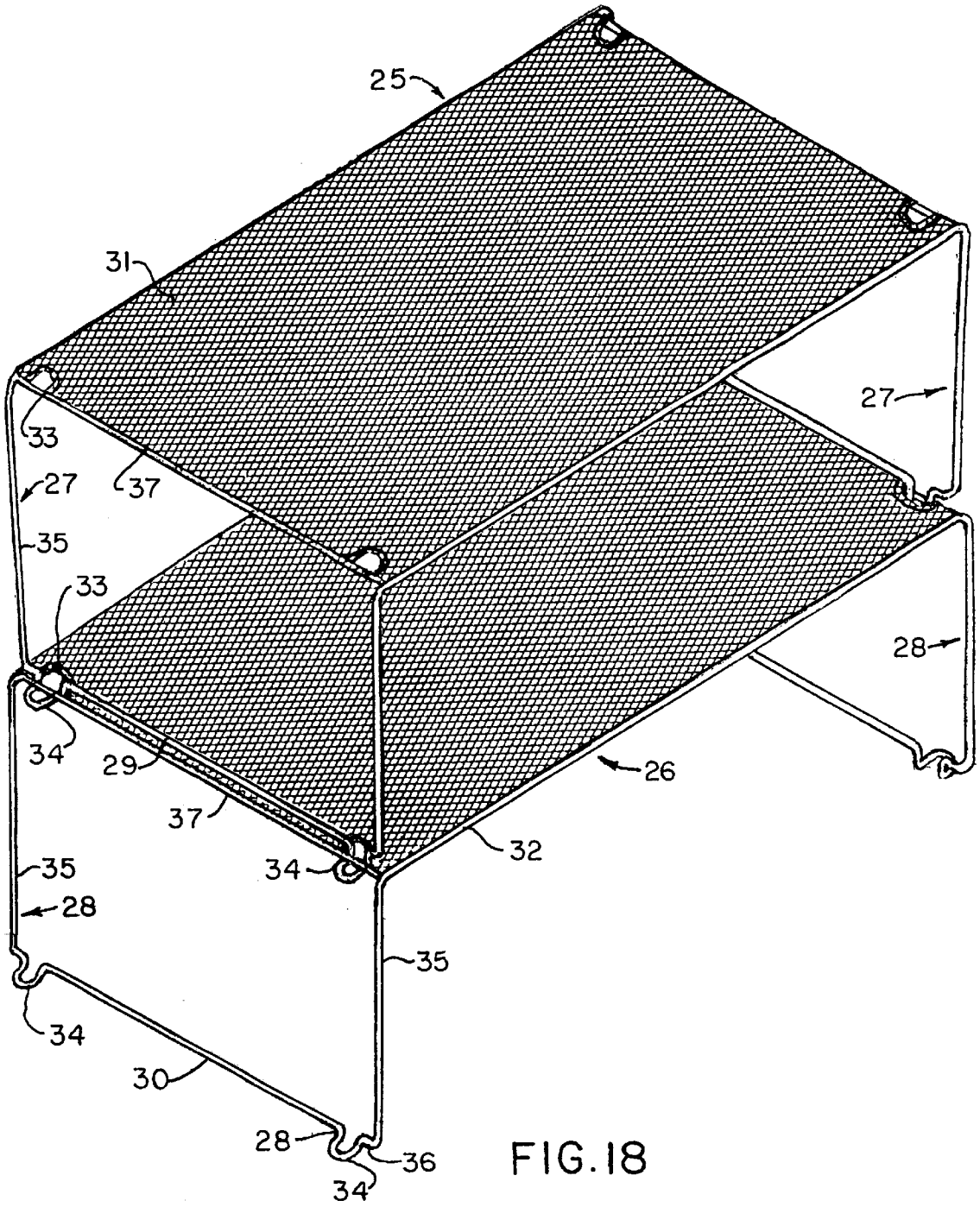
FIG. 18 is an isometric view of a pair of modified racks vertically stacked.

FIG. 18 discloses a slightly different variation upon the stackable and nestable rack, which in this particular instance, it can be seen that a pair of racks 25, 26 may be stacked one upon the other, and interconnected together in order to assure that the two racks will remain held together, when stacked one upon the other, but at the same time, the racks may nest, when separated, so as to reduce their volume when in storage, during shipment, or when displayed for sale.

As can be seen, in this particular instance, each rack, at an end, has formed legs 27 and 28, which are integrally formed having foot portions 29 and 30, as noted. The platform or surface 31 and 32 for each rack, in this particular instance, is formed of a mesh work of metal, plastic, or the like, as disclosed. Proximate each corner of the platform of each rack is provided an aperture therethrough, as at 33, as can be seen. Each foot portion 29 and 30 has a tab-like foot member 34 that is arranged slightly inwardly from the respective legs 35, by a distance generally equivalent to the length of the short segment 36 of each foot portion, as shown. In this particular instance, these foot tabs 34 are designed for extending through the apertures 33, of a rack arranged there below, and since the legs will have been biased inwardly, the foot tabs will extend underneath and forwardly of the upper side frame rod 37, through each of their associated apertures 33, and with the midpart of the foot portion 29 being arranged above the grid work surface 31 or 32, the racks will be sustained in place, interlocked together, to assure their retention together, during usage.

As previously explained, since each of these racks are both nestable and stackable, in the configuration, the end frames 27 and 28 will angulate slightly outwardly towards their bottom foot portions, and each end frame will need to be biased inwardly, towards each other, in order to align their foot tabs 34 with the associated apertures 33, allow their entrance into the apertures 33, and then released, so that the short length of each foot tab, as can be seen at 38, will bias against the end frame upper rod 37, to secure the pair of racks in position, once assembled.

It is just as likely that these foot tabs 34 may extend inwardly, rather than outwardly, and allow for their locating the apertures 33, in order to secure the pair of racks together, once vertically assembled.

Figure 19:
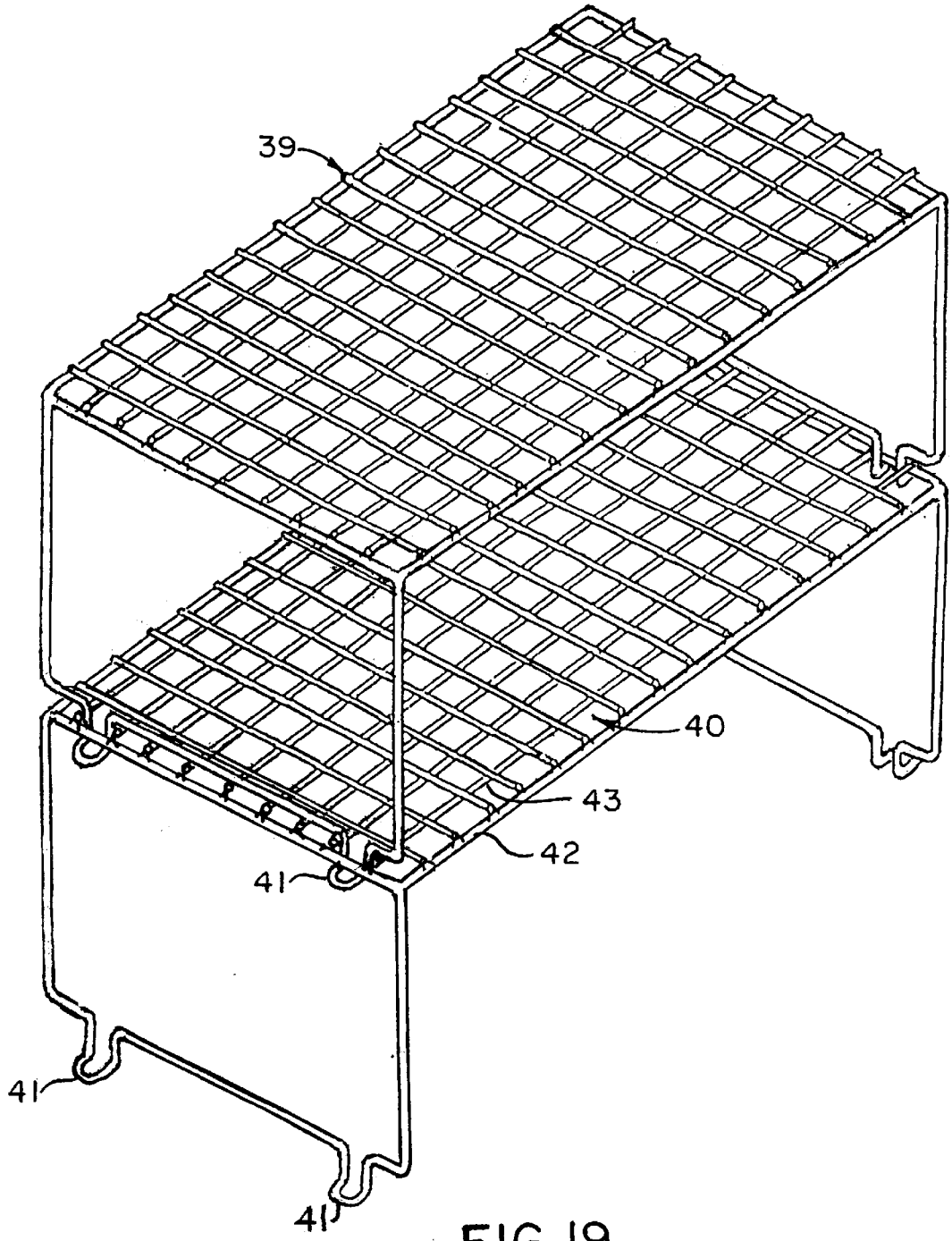
FIG. 19 is an isometric view of a further pair of modified racks vertically stacked.

A similar type of arrangement for the stackable and nestable racks of this development are also shown in FIG. 19, but in this particular instance, the surface platforms 39 and 40 are shown formed as grid work of a series of either longitudinally or laterally arranged grid wires, or perhaps just longitudinally arranged wires, with the foot tabs 41 designed for inserting through the space between the longitudinal wires 42 and 43, as can be noted, for securing a pair of the racks together, once assembled. As previously explained, it is just as likely that these foot tabs could be erected or bent inwardly, rather than outwardly, as shown, in order to provide for engagement of a pair of racks together, once stacked. In addition, these racks may nest together, as when not in use, in order to conserve storage or shipping space.

Hence, the improved rack, of the stackable and nestable type, as described herein, is an enhancement over prior art designs primarily because it provides a generally smooth surface platform to form its upper surface, and which can have stored thereon items of a variety of dimensions, without interference from any upstanding components that form the rack structure itself. In addition, that even though the rack is designed in this manner, it yet provides enhanced stackability, and nestability, where the stackability feature assures that the racks may be held together, even when a plurality of them are stacked one upon the other, and an effort is made to lift all of the racks together, even though goods may have been previously applied thereon. Furthermore, the method of assembly of this particular rack is rather unique from the standpoint that it can be generally formed as a two-dimensional item, having a reasonably planar configuration, as previously shown and explained in FIGS. 6 and 7, and 15 and 17, which facilitates their storage, shipment, particularly where long distances may be involved, before they are finally bent and assembled into the usable configuration, where their legs are bent into an upstanding configuration, at the vertical disposition, as shown in FIG. 14, or the near vertical arrangement, as shown in FIG. 2, and as previously explained.

Variations or modifications to the structure, method of assembly, and usability of nestable and stackable racks of this invention may occur to those skilled in the art upon reviewing the description of the embodiment provided herein. For example, it is conceivable that the feet formed of a rack of this invention may bend inwardly, rather than outwardly, and still function just as effectively to stack two or more of the racks on top of each other. Such variations or modifications, if within the spirit of this invention, are intended to be encompassed within the scope of any claims to patent protection issuing upon a rack of these designs. The description of the preferred embodiment set forth herein, and as shown in the drawings, are set forth for illustrative purposes only.

Having thus described the invention, what is claimed and desired to be secured by Letters Patent is:

1. In rack constructed of wire components formed to permit stacking and nesting when at least two of said racks are employed, the improvement comprising:

substantially vertically erect leg members formed of wire and provided at each end of the rack, a substantially horizontally extending foot extending substantially entirely across each end of the rack, formed of wire, provided respectively at the lower ends of the leg members at each end of the rack;

a substantially elongated wire structure extending the length of the rack and interconnecting and retaining the leg members fixedly at opposite ends of the said wire structure, said wire structure formed to support articles thereon, said wire structure having apertures provided proximate each of its corners, each horizontally extending foot being connected to the leg members at a respective end of the rack by a pair of foot portions, each pair of foot portion is in an offset position provided for inserting through and turning under the formed apertures of said wire structure of an adjacent rack there below so that the racks will be vertically stacked while having the horizontally extending foot at each end of the rack resting upon the elongated wire structure of the subjacent rack that is arranged there below;

each foot portion disposed a distance below said wire structure so as to provide space under said wire structure to accommodate articles stored there below on the wire structure of the subjacent rack; and each foot portion of said rack that cooperates with the apertures of the wire structure of the subjacent rack is arranged to provide for an engaging securement of the pair of racks when stacked, and each wire leg member has sufficient flex to provide for its bending during an engagement of said foot portion in the wire structure of the subjacent rack.

2. The rack of claim 1 wherein said wire structure comprises elongated wire grid structures forming a wire shelf.

3. The rack of claim 1 wherein said wire structure is formed as a mesh wire structure.

4. The rack of claim 1 wherein said foot portions are adapted to connect a pair of racks together, while the horizontally foot extending therebetween vertically supports the rack upon the wire structure of the subjacent rack.

5. The rack of claim 1 wherein said foot portions are extended outwardly a minor distance from the horizontally extending foot.

6. The rack of claim 1 wherein said foot portions extend outwardly from said vertical legs and the horizontal extending foot of the rack extends slightly above the foot portions.

7. The rack of claim 1 wherein said foot portions extend outwardly at a small angle from the vertical legs in order to generate a biasing force when the foot portions are inserted in the apertures of the subjacent rack.

8. The rack of claim 1 wherein each foot portion has a projection extending outwardly to fix a pair of racks vertically when the foot portions of an upper rack are inserted through the apertures of the subjacent rack.

9. The rack of claim 1 wherein said rack as formed of wire components to be selectively positionable is initially fabricated substantially in a flattened condition, with foot portions maintaining a substantially flat position with respect to said wire structure of the rack.

* * * * *